US005727640A

United States Patent [19]

Gleditsch

[11] Patent Number: 5,727,640

[45] Date of Patent: Mar. 17, 1998

[54] DEEP WATER SLIM HOLE DRILLING SYSTEM

[75] Inventor: Svein Gleditsch, Lundenes, Norway

[73] Assignee: Mercur Subsea Products AS, Harstad, Norway

[21] Appl. No.: 550,495

[22] Filed: Oct. 30, 1995

[30] Foreign Application Priority Data

Oct. 31, 1994 [NO] Norway ..... 944136

[51] Int. Cl.[6] ..... E21B 7/128

[52] U.S. Cl. ..... 175/7; 166/358

[58] Field of Search ..... 175/7; 166/358, 166/359, 363, 364, 365

[56] References Cited

U.S. PATENT DOCUMENTS

| | | | |
|---|---|---|---|
| 3,179,179 | 4/1965 | Kofahl | 166/363 X |
| 3,424,253 | 1/1969 | Triplett | 175/7 |
| 3,603,409 | 9/1971 | Watkins | 175/7 |
| 3,825,065 | 7/1974 | Lloyd et al. | 166/351 |
| 3,913,668 | 10/1975 | Todd et al. | 166/359 |
| 4,046,191 | 9/1977 | Neath | 166/0.5 |
| 4,193,455 | 3/1980 | Steddum et al. | 166/359 |
| 4,291,772 | 9/1981 | Beynet | 175/5 |
| 4,557,332 | 12/1985 | Denison et al. | 166/359 |
| 4,632,188 | 12/1986 | Schuh et al. | 166/368 |
| 5,199,683 | 4/1993 | Le | 251/1.3 |
| 5,533,574 | 7/1996 | Gonzalez | 166/358 |

OTHER PUBLICATIONS

Norman J. Hyne, Ph.D., "Dictionary of Petroleum Exploration, Drilling & Production", PennWell Books 1991, p. 46.

*Primary Examiner*—Hoang C. Dang

*Attorney, Agent, or Firm*—Hedman, Gibson & Costigan, P.C.

[57] ABSTRACT

The present invention relates to an arrangement to be used when drilling oil/gas wells, especially deep water wells, and the invention gives instructions for how to utilise the riser pipe as part of a high pressure system together with the drilling pipe, namely in that the arrangement comprises a surface blowout preventer (SURBOP) which is connected to a high pressure riser pipe (SR) which in turn is connected to a well blowout preventer (SUBBOP), and a circulation/kill line (TL) communicating between said blowout preventers (SURBOP, SUBBOP), all of which being arranged as a high pressure system for deep water slim hole drilling.

11 Claims, 3 Drawing Sheets

DEEP WATER SLIM HOLE DRILLING SYSTEM

FIELD OF THE INVENTION

The present invention relates to a deep water slim hole drilling system, and more specifically to an arrangement for use in drilling of oil/gas wells, especially deep water wells, which arrangement comprises a surface blowout preventer (BOP) which is connected to a riser which in turn is connected to a well comprising means for controlling fluid into and out of the well, said well as known per se comprising a well BOP stack.

PRIOR ART

U.S. Pat. No. 5,199,683 relates to a blowout preventer which comprises an apparatus for allowing the pressure above and below its rams to equalize before the rams are opened. At least one of the rams has a bypass passageway therethrough disposed so as to allow communication between well zones above and below the rams, respectively. The bypass passageway also has a straight-sided tubular sealing section intermediate its ends. A sealing piston carrying a circumferential seal sized to engage the sealing section of the bypass passageway is reciprocable in that passageway to move the circumferential seal into and out of engagement with the sealing section and thereby respectively prevent or permit fluid flow through the bypass passageway. Where the actuator shaft for the ram is connected to the ram by a lost motion type connection, the sealing piston may be carried on the shaft. The sealing piston or other valve member may be carried on a carrier loosely mounted on an inner end of the shaft for lateral play, thereby allowing for "self-centering" of the valve element with respect to the surface against which it must seal.

U.S. Pat. No. 4,632,188 relates to a subsea wellhead apparatus that includes the conventional plurality of strings of conduit suspended in a borehole penetrating subterranean formations below the bottom of a sea at which the wellhead apparatus will be placed and the conventional wellhead and accessories disposed above the bottom and the plurality of strings of conduit; comprising a first communications aperture communicating with a first annular space intermediate a desired pair of conduit strings; a sealed conduit that defines a sealed path of flow for flowing a fluid waste into the annulus intermediate the respective conduit strings; remotely operable high pressure control valves interposed in the conduit for controlling the flow of fluid between the annular spaces and a remote control for controlling the flow control valves so as to route the fluid waste to the first annular space and fractured formation communicating therewith.

U.S. Pat. No. 4,046,191 relates to a method and apparatus used for offshore drilling operations which is particularly useful in those operations where a floating vessel or drilling platform is situated at the surface of a body of water with a riser assembly extending between the platform and the well and a blowout preventer assembly is positioned therebetween near the lower end of the riser assembly. In the practice of this invention at least one fluid bypass conduit provides a path for high pressure fluid to flow from the wall at a point below at least one of the blowout preventers to the riser assembly at a point below the surface of the water and above the blowout preventer assembly. A means in each of said bypass conduits controls the flow of fluid through the conduit to regulate the fluid pressure in the well when the blowout preventers are in the closed position.

U.S. Pat. No. 3,603,409 relates to a method and apparatus for maintaining a pressure balance between internal and external subsea well pressures during underwater drilling, entry and reentry operations conducted from a floating vessel remote from the subsea wall comprising injecting gas into the wellhead apparatus in amounts sufficient to cause the density of the well fluid or mud returns below the surface of the sea to approximate the density of sea water and controlling the injection of such gas and thus the internal well fluid pressures by sea water well pressure differential and control means associated with valve means located in gas injection and return lines at the subsea well apparatus.

U.S. Pat. No. 3,424,253 relates to methods of drilling and working on wells in submerged formations entailing the use of conduit means extending from a submerged wellhead to a floating vessel, the jetting-in of a casing attached to wellhead equipment, the cementing in of casing, and the guiding of drilling equipment.

From "Dictionary of Petroleum Exploration, Drilling, & Production" by Norman J. Hyne, Ph.D., issued by PennWell Books 1991, page 46 it is in connection with a blowout-preventer stack previously known that an offshore double stack will have blowout preventers both on the seabed and on the offshore drilling rig. The use of two BOP stacks, one at the surface and one at the seabed connected with a riser pipe is, as such, not novel for platforms or stationary anchored platforms. However, in connection with the solution suggested by the present invention this combination of surface BOP and seabed BOP can be used in connection with floating drilling rigs without flexible couplings as telescope system in order to compensate for the heave movements of the rig.

OBJECTS OF THE PRESENT INVENTION

An object of the present invention is to give instructions for utilizing a riser pipe as part of a high pressure system together with the drilling pipe.

Another object of the present invention is to give instructions for an arrangement comprising a surface blowout preventer or BOP stack which will form the main pressure control barrier, a high pressure riser pipe which is adapted for housing the drilling string, as well as a subsea blowout preventer adapted to disconnect the riser pipe system and secure the well at the seabed, especially in connection with slim hole drilling.

Still another object of the present invention is to provide an arrangement wherein a subsea blowout preventer stack should allow for pressure control through a separate high pressure circulation and test hose included in the control umbilical.

Yet another object of the present invention is to provide an arrangement wherein a high pressure telescope system is dispensed with, and rather provide a compensating system for the riser pipe to be implemented in a compensating system for the drill deck which will be stationary in relation to the seabed.

Another object of the present invention is to provide a high pressure riser pipe system requiring a minimum of gaskets for thereby being less prone to errors.

SUMMARY OF THE INVENTION

The above objects are achieved in an arrangement as stated in the preamble, which is characterized in that said surface BOP stack is connected to a high pressure riser which in turn is connected to a well CTBOP stack, and which also is adapted to make the choke line between said BOPs superfluous, and that between said BOPs there is arranged a combined circulation/kill line, all of which are arranged as a high pressure system for deep water drilling from floating drilling devices providing slim drilling holes, said riser preferably being supported by a tensioning system.

Further features and advantages offered by the present invention will appear from the following description taken in connection with the appended drawings, as well as from the appended patent claims.

BRIEF DISCLOSURE OF THE DRAWINGS

DETAILED DESCRIPTION OF EMBODIMENTS

Figure 1:
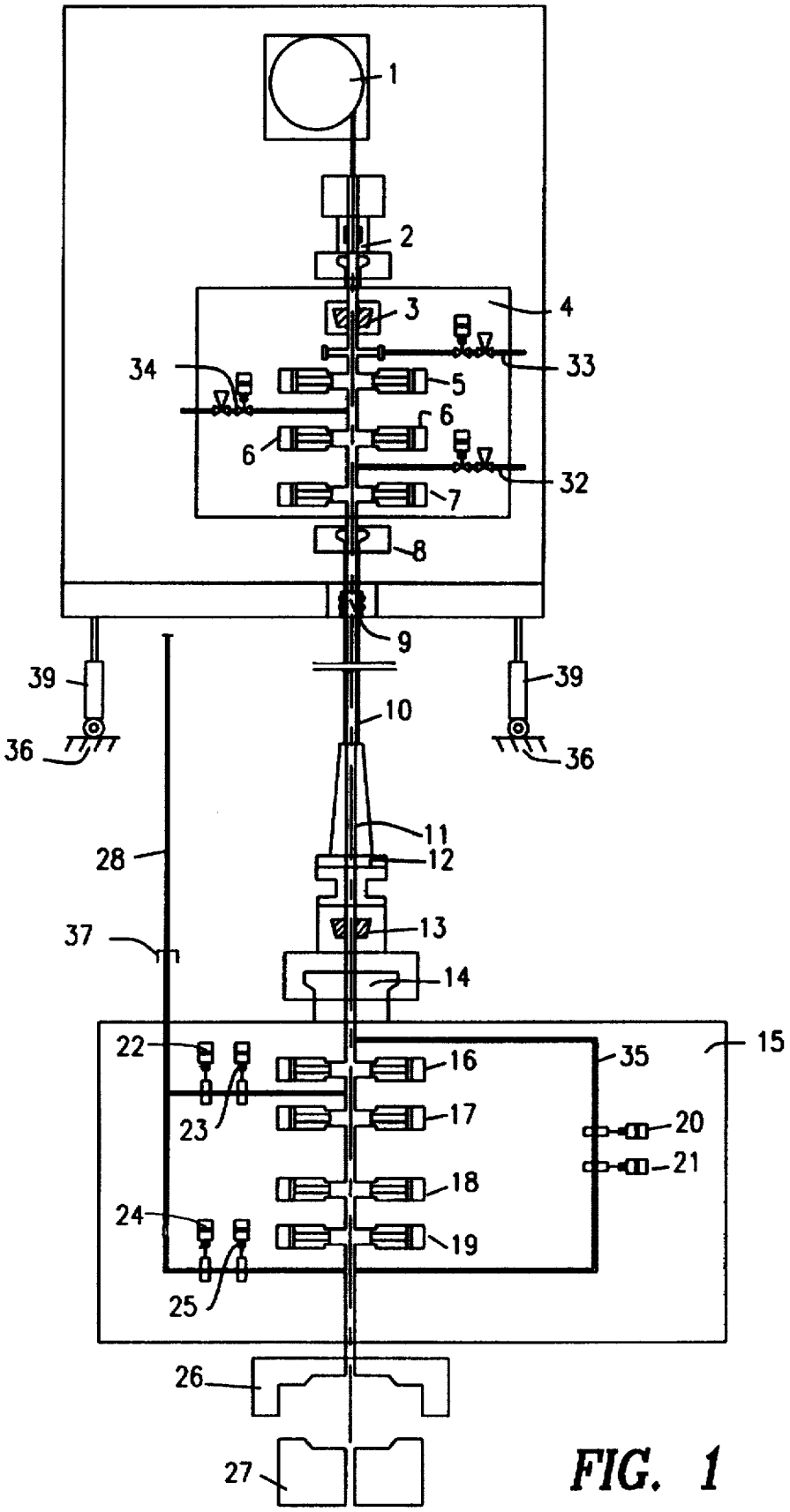
FIG. 1 is an overall view illustrating the valves and lines included in an embodiment of an arrangement according to the present invention.

Reference is made to the enclosed FIG. 1 illustrating valves and lines included in an embodiment of an arrangement according to the present invention.

In order to fully understand the present novel deepsea technology which operates from a small dynamically positioned drilling vessel, it will in the following be given a combined description and objective regarding the equipment associated with operational evaluations and activities.

In connection with subsea slim hole drilling in deepwater by means of coiled pipe or drilling pipe, it is according to the present invention suggested a novel 9⅝" (345 bar or 690 bar) CTBOP ("Coiled Tube Blowout Preventer") 15 which has been designed in order to provide a well having a plurality of sections.

Said CTBOP system for deepwater application will comprise a configuration wherein a subsea CTBOP stack 15 is attached to the wellhead 27 at the seabed. A surface BOP stack 4 constitutes the upper terminal point for a high pressure riser pipe system 10, which is rigidly connected to a compensated drill deck 39. The surface BOP stack 4 will constitute the main pressure control barrier, whereas the subsea CTBOP stack 15 will be designed in order to disconnect the riser pipe system 10 and secure the well at the seabed. The subsea CTBOP stack 15 will allow for pressure control via a separate high pressure circulation and test hose 28, which is included in the control umbilical 31. This hose is not firmly connected with said subsea CTBOP stack 15, but is connected up to this by means of a remotely controlled subsea vessel according to circumstances.

Further, said control system will comprise a deepwater related electrohydraulic multiplex system 30. Because all functions are hydraulically fail-safe, only one control system will be sufficient.

The present invention gives instruction for combining elements in a new manner which makes possible slim hole drilling or "Snubbing" at deepwater levels.

Said CTBOP system comprises a novel wellhead system 27. This system caters for the necessary security meeting the requirement of emergency connection of a second drilling vessel. The wellhead system comprises a high pressure slim hole wellhead (9⅝") 27 and a high pressure large hole wellhead (18¾") 28. Between said wellheads there is mounted a novel high pressure gasket 29 which can be mounted or demounted by means of an appropriate tool. This novel gasket 29 is specific in that it is designed for resisting pressure from both sides, whereas traditional gaskets can only resist pressure from one side.

Further, said CTBOP system comprises a subsea CTBOP stack 15 of valves.

This can comprise the following four rams:

| | |
|---|---|
| SCDSR, SUBSEA CASING/DRILLPIPE SHEAR/SEALING RAM, | 16 |
| SCTSSR, SUBSEA COILED TUBING/SHEAR/SEALING RAM, | 17 |
| SVDPR, SUBSEA VARIABLE BORE DRILLPIPE RAM, | 18 |
| SCTGSR, SUBSEA COILED TUBING GRIP/SEAL RAM, | 19 |

This novel SCDSR 16 is specifically designed to resist high pressure both from the upper side and from the lower side. This is necessary for thereby allowing the high pressure riser pipe 10 to be tested after disconnection and connection of riser pipe 10. The well can then be pressurized and the connection between the riser pipe 10 and the CTBOP 15 must be tested before the well is reopened.

In connection with an abrupt emergency situation, for example by drifting off of the surface vessel, said rams will be used in a specific sequence, depending on whether there is used a regular drilling string or a coiled drilling string, and then in first instance to close around the pipe, using SVDPR 18 or SCTGSR 19, whereafter the drilling pipe or the drilling coiled pipe is cut together with the associated part of the casting, for sealing off the well, namely by means of the ram SCDSR 16 or SCTSSR 17.

The lower part of the riser pipe 10 comprises a hydraulic quick connection 14 serving to disconnect the drilling device from the CTBOP stack 15 on the wellhead 27.

Above the quick connection 14 there is mounted an environment valve 13 (Riser Environmental Shut-Off Valve). The purpose of this is to secure that pollutions from the contents of the high pressure riser pipe 10 will not leak into the ocean during a quick disconnection. The valve 13 is so designed that it automatically shuts off the annulus between the cut pipe and the inner diameter of the riser pipe during an emergency disconnection from said CTBOP stack 15.

Further, the valve 13 is so designed that the cut pipe can be pulled up through the riser pipe 10 without letting environment polluting liquid leak out of the riser pipe 10.

Between the environment valve 13 and the bending section 11 of the riser pipe the system comprises a weak link 12, at which point the riser pipe 10 will get loose in case of overload. This will come into operation in those cases wherein the drilling device unintentionally moves away from the vertical axis, at the same time as the quick connection 14 of the CTBOP stack 15 fails.

The weak link 12 is so designed that another high pressure riser pipe 10 can be connected by means of a standard hydraulic connection 14.

In order to enable the ship to be turned in relation to existing winds and currents said CTBOP 15, high pressure riser pipe system 10 and said surface-related drilling equipment 1 will allow such turning of the vessel. Consequently, there is suggested a turnable high pressure swivel connection 9, which is integrated in the upper section of the riser pipe assembly, and this will allow for the vessel to turn around the drilling vertical.

When re-connecting the riser pipe 10 to said CTBOP stack 15 after an emergency disconnection, the circulation line 28 will come into effect, said line, as appearing from FIG. 1, being illustrated as connected at 37 to an output between the two upper said cutting/ceiling-rams SCDSR 16 and SCTSSR 17, and said circulation line 28 also comprising a second branch having access to the top of the well 26, or to the drilling hole below the annulus of said lower ram SCTGSR 19. From this position at the top of the well 26 also said bypass-line 35 branches off, said bypass-line 35 also having a connection above the upper ram SCDSR 16.

This ram annulus comprises rams which provide a two-way sealing in order to allow for testing of the riser pipe 10 during a re-connection, which is particularly the case for the ram designated SCDSR 16.

Specifically with regard to the ram SCTSSR 17 this is designed so as to cut and seal the coiled drill string during a disconnection. This specific ram 17 will cut the pipe and leave a circular upper cut surface for attaching a riser sleeve and allow for an unrestricted flow path to the inner of the pipe. This ram 17 only needs to withstand the pressure from the bottom side of the annulus of the ram.

Said ram SVDPR 18 preferably serves as a sealing against the drilling pipe or an alternative pipe string which is used in the system, the variable drilling hole area also comprising a coiled pipe string 1. This ram will allow for "hang-off" of a 5" or a 3½" drilling pipe connection if a controlled disconnection with drilling pipe in the drilling hole is required. For this ram annulus it is not necessary with a gripping ram.

The lowermost ram SCTGSR 19 has as its main task to clamp around the drilling string and maintain a pressure sealing on the coiled pipe during a disconnection operation. This ram will not be used during normal drilling operations.

Upon re-connection of the upper BOP stack 4 and the seabed oriented CTBOP stack 15 it is necessary for the vertical mainhole in the lower CTBOP stack 15 to have access to separate access lines, namely by means of the previously discussed circulation line 37, also designated circulation/kill line, as well as the bypass-line 35, connected as previously discussed, in the lower CTBOP stack 15.

At each inlet to the annulus of the CTBOP stack 15, there are provided isolation valves, UOKV 22, UIKV 23, and LOKV 24, LIKV 25, respectively, whereas in the bypass-line 35 there are provided two bypass valves LBV (lower bypass valve) 21 and UBV (upper bypass valve) 20, respectively, which valves are used to isolate the drilling hole pressure, at the same time as the bypass-line 35 may serve as a kill line.

Said circulation/kill line 28 can thus be used for circulating out said riser pipe 10, testing of the subsea CTBOP stack 15 and verifying the well at re-connection of the upper BOP stack 4 to the lower CTBOP stack 15. Said circulation/kill line 28 will be attached to the riser pipe 10 when said riser pipe is in operation, and will be given nominal pressure at the same level as said CTBOP stack 15 and said riser pipe system 10.

The present invention also gives instructions for how the use of the high pressure riser pipe 10 can favour underbalanced drilling in deepwater, namely by letting said circulation/kill line 28 be used for injection of gas, which during a drilling operation will involve that the drilling can be effected faster since pressure in the drilling hole favours the material flow. As previously known, heavier mud will lead to an overstabilized well, and thereby slower drilling, whereas the introduction of for example nitrogen gas in the upper hydraulic column, will favour the drilling speed and thereby a more favourable utilization of drilling equipment.

In FIG. 1 it is also illustrated where said closing valve 13 is located. Such a closing valve 13 will prevent liquid in the riser pipe 10, which is heavier than water and may contain crude oil, from being discharged from the riser pipe 10 to surrounding water bodies.

Figure 3:
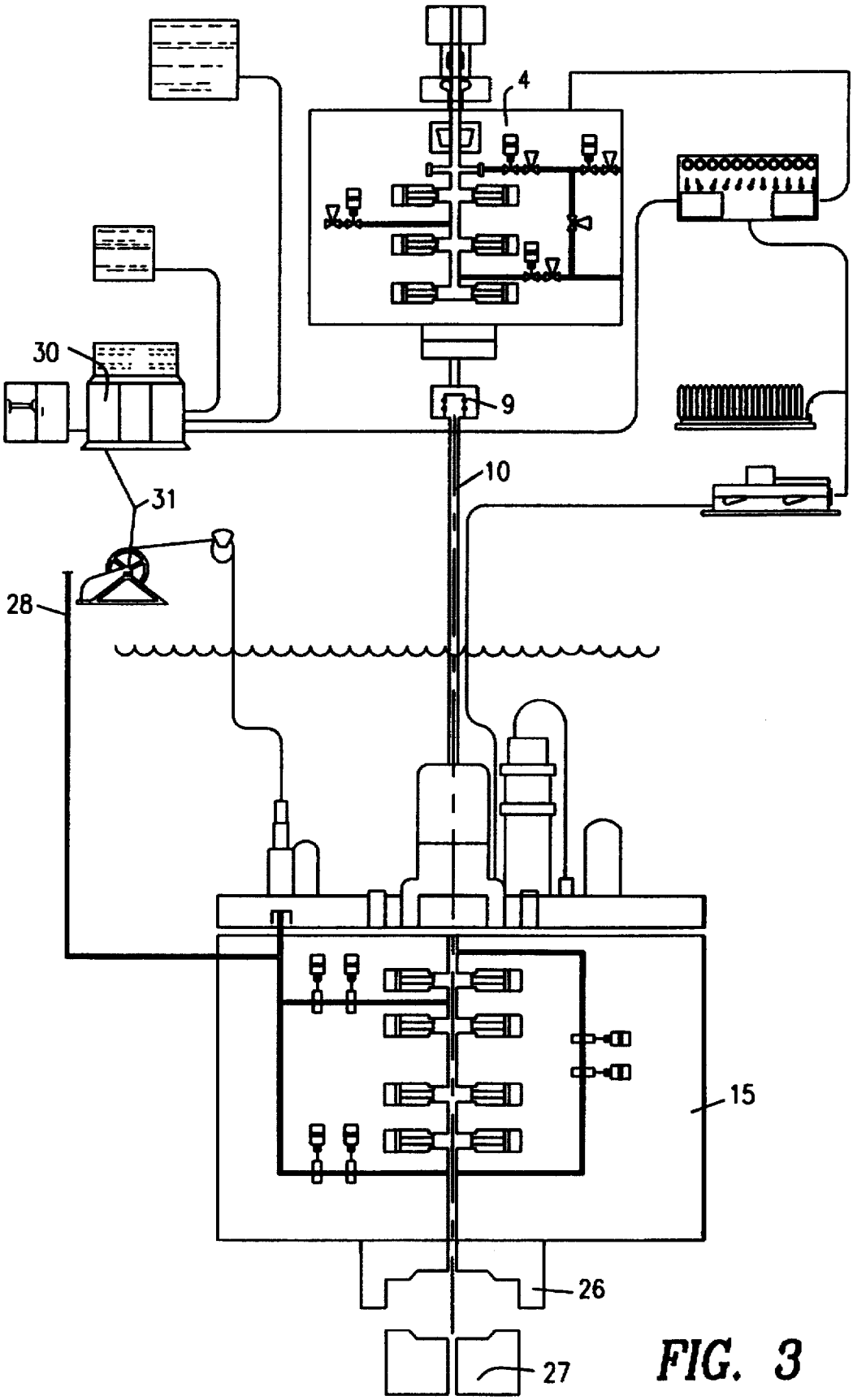
FIG. 3 is an overall view illustrating an example of system components included in an embodiment of an arrangement according to the invention.

In FIG. 3 it is illustrated that the present arrangement comprises hydraulically fail-safe control circuits for the operation of said system, i.e. both for said surface BOP stack 4 and said subsea CTBOP stack 15, especially a multiplex system 30 comprising electrically controlled and/or hydraulically controlled components. In other words, according to the present invention it is suggested to operate with valves and associated equipment which for example can sense a certain work pressure, and which upon failure or stop in the hydraulic supply, can react to decreasing pressure and thus take a closed position at pressure drop.

In FIG. 1 it is illustrated where said high pressure swivel 9 is located.

Further, with reference to FIG. 1, it is here illustrated how the upper BOP stack 4 is arranged in order to provide the service functions thereof, which in connection with previously known systems were arranged in the lower CTBOP stack 15. Consequently, the upper BOP stack 4 comprises three rams, namely LSGSR (Lower Surface Grip and Seal Ram) 7, USGSR (Upper Surface Grip and Seal Ram)6 and USSSR (Upper Surface Shear and Seal Ram) 5, which is directly connected to a high pressure riser pipe 10, as well as associated circulation-line connections 32 and 33, which in turn are regulated by means of appropriate valves, for communication between said upper BOP stack 4 and said lower CTBOP stack 15 with said circulation/kill line 28 and the associated mud circulation system.

SUMMARY OF RELEVANT ITEMS

An important feature of the present arrangement is the assembly of a plurality of subsea modules, which together define a high pressure system for subsea drilling with slim drilling holes, from a floating drilling vessel, and wherein the riser pipe is firmly connected to a compensated drilling system, see especially FIG. 1.

Figure 2:
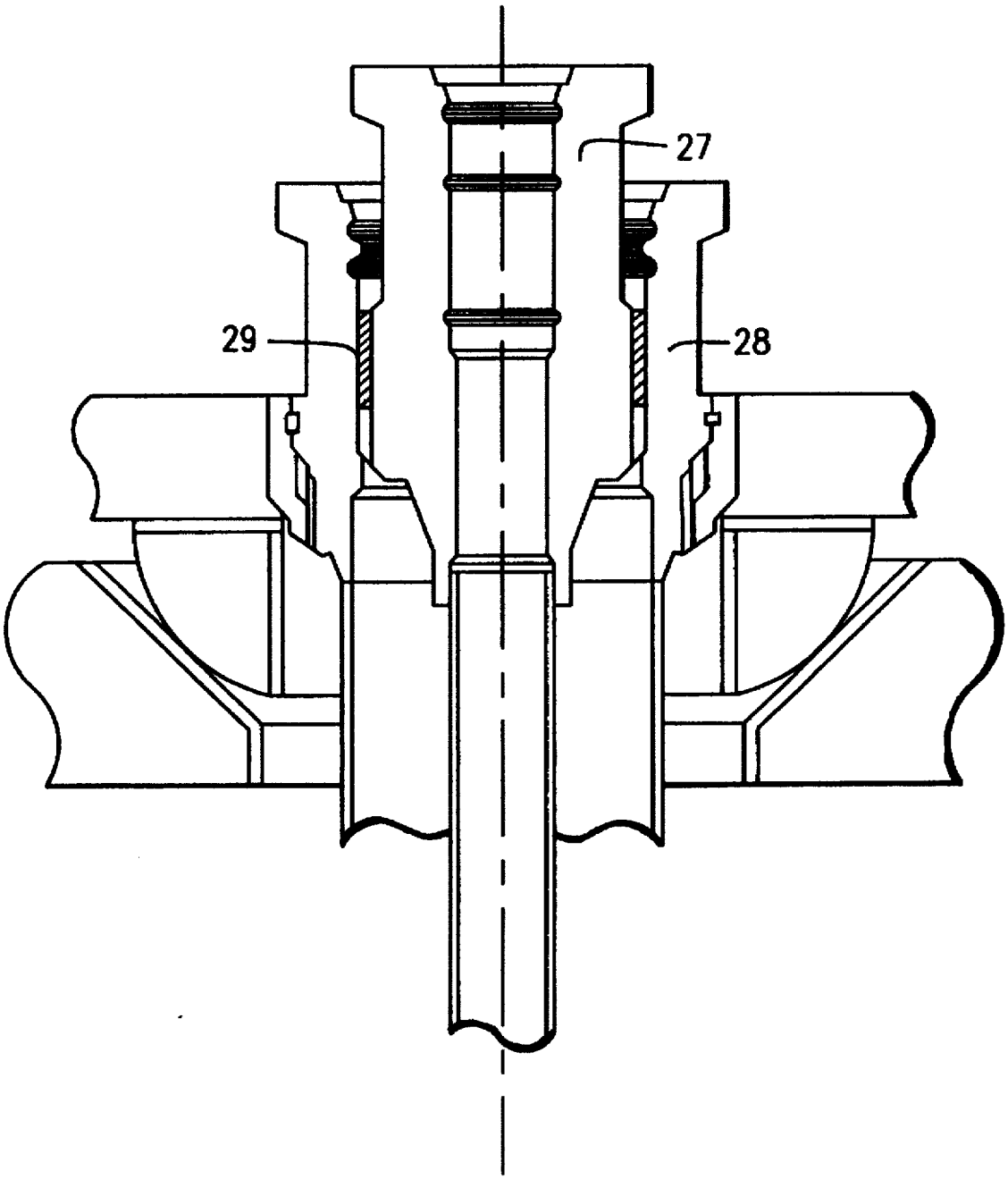
FIG. 2 is a schematical view illustrating details in an embodiment of a double wellhead according to the present invention.

Another feature of the present arrangement is a wellhead having a double function, said wellhead being adapted for access to said well via either a vessel adapted for slim hole drilling or a conventional vessel, and wherein the wellhead comprises a high pressure gasket located between said two wellheads, and wherein the gasket resists pressure from the bottom side and top side, see especially FIG. 2.

Another feature of the present arrangement is a slim hole wellhead adapted for being attached to a wellhead of standard size, see specifically FIG. 2.

A further feature of the present arrangement is the inclusion of a shut off valve (Environmental Shut Off Valve), which is connected to a riser pipe, and which serves to avoid pollution of surrounding water when said high pressure riser pipe is disconnected.

A further feature of the present arrangement is the inclusion of a cutting ram for casing and coiled pipe with the possibility of two-way sealing.

Still another feature of the present arrangement is the inclusion of a weak link in the lower part of the riser pipe, said link comprising a profile for remote connection of another riser pipe.

Still another feature of the arrangement according to the invention is the inclusion of hydraulically fail-safe control circuits for the operation of the system, especially a multiplexed control system comprising electrically controlled and/or hydraulically controlled components, and wherein there is provided a control conduit in the fail-safe system instead of a traditional double control system, see FIG. 3, which feature favours a fail-safe and mode versatile operation, both as regard coiled pipe operation and drilling pipe operation.

Another feature of the present arrangement is the inclusion of means for injecting gas, for thereby allowing underbalanced drilling at deepwater, see specifically FIG. 1.

Still another feature of the arrangement according to the present invention is the inclusion of a high pressure swivel connection, preferably located below the surface-related BOP stack and above the uppermost riser pipe connection, see FIG. 1.

Another feature is the inclusion of a flexible connection, preferably below the upper riser pipe connection, for thereby allowing large sideways movements of associated vessel.

Another feature of the present invention is the inclusion of an assembled blowout preventer which is directly connected to a high pressure riser pipe and associated circulation-line connections, specifically comprising three blowout preventers, see particularly FIG. 1.

I claim:

1. Arrangement for use in drilling of deep water oil/gas wells, characterized in that the arrangement comprises a surface blowout preventer which is connected to a high pressure riser pipe which in turn is connected to a well blowout preventer, and a circulation/kill line communicating between said blowout preventers, said well blowout preventer comprising pipe rams for casing pipe and coiling pipe, respectively, with the possibility of two-ways sealing, said pipe rams being connected with said circulation/kill line and encompassed by a bypass line wherein said circulation/kill line in the well blowout preventer has a first branch connected to an outlet between two upper pipe rams and a second branch connected to an outlet below the lowermost pipe ram and having access to a drilling hole below said latter pipe ram and the top of the well.

2. Arrangement as claimed in claim 1, characterized in that said bypass line runs from the top of the well and from the lower side of the annulus of the lower pipe ram and to the uppermost pipe ram.

3. Arrangement as claimed in claim 2, characterized in that in each branch of the circulation/kill line to the well blowout preventer of the drilling hole there are provided two isolating valves, whereas in the bypass line there are provided two bypass valves.

4. Arrangement as claimed in claim 1, characterized in that the arrangement comprises means for injection of gas through said circulation/kill line for thereby allowing under balanced deep water drilling.

5. Arrangement as claimed in claim 1, characterized in that the arrangement comprises a shut-off valve which is connected to the riser pipe, and which serves for preventing liquid in the riser pipe to leak out to the surrounding water when disconnecting the high pressure riser pipe.

6. Arrangement as claimed in claim 1, characterized in that the arrangement comprises fail safe control circuits for the operation of a multiplex deep water slim hole drilling system comprising electrically controlled and/or hydraulically controlled components.

7. Arrangement as claimed in claim 1, characterized in that the arrangement comprises a high pressure swivel below the surface blowout preventer and above the upper pipe ram.

8. Arrangement as claimed in claim 1, characterized in that it comprises an assembled blowout preventer in said surface blowout preventer, which is directly connected to said high pressure riser pipe and associated circulation/kill line, comprising three blowout preventers.

9. Arrangement as claimed in claim 1, characterized in that the arrangement comprises means to adapt a slim hole wellhead for attachment to a wellhead of standard size.

10. Arrangement as claimed in claim 1, comprising a flexible connection located below the upper pipe ram for thereby allowing large sideways movements of an associated vessel.

11. Arrangement as claimed in claim 1, characterized in that in each branch of the circulation/kill line to the well blowout preventer of the drilling hole there are provided two isolating valves whereas in the bypass line there are provided two bypass valves.

* * * * *